US006669499B2

(12) United States Patent
Whyne et al.

(10) Patent No.: US 6,669,499 B2
(45) Date of Patent: Dec. 30, 2003

(54) CONTACT FOR PIN GRID ARRAY CONNECTOR AND METHOD OF FORMING SAME

(75) Inventors: Richard Nicholas Whyne, Mechanicsburg, PA (US); Richard W. Grzybowski, Lebanon, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/119,072

(22) Filed: Apr. 9, 2002

(65) Prior Publication Data

US 2003/0190833 A1 Oct. 9, 2003

(51) Int. Cl.[7] ..... H01R 13/625
(52) U.S. Cl. ..... 439/342; 439/857
(58) Field of Search ..... 439/342, 266, 439/268, 856, 862, 857

(56) References Cited

U.S. PATENT DOCUMENTS 4,498,725 A 2/1985 Bright et al.
4,702,545 A * 10/1987 Moyaert ..... 439/856
4,850,904 A * 7/1989 Shimizu ..... 439/856
5,443,591 A * 8/1995 Tsai ..... 439/342
5,609,495 A * 3/1997 McHugh ..... 439/268
5,997,317 A 12/1999 Pei et al.
6,024,584 A 2/2000 Lemke et al.
6,113,411 A 9/2000 Lu et al.
6,142,810 A 11/2000 Hsiao et al.
6,312,276 B1 * 11/2001 Lin ..... 439/342
6,336,823 B2 * 1/2002 Lemke et al. ..... 439/342
6,450,826 B1 * 9/2002 Howell et al. ..... 439/342

* cited by examiner

*Primary Examiner*—Alexander Gilman

(57) ABSTRACT

A pin grid array contact has been provided that includes a planar main body and first and second spring beams. The planar main body defines, and is arranged within, a primary contact plane. The main body has edges along opposed sides and along opposed ends. The first and second spring beams are formed integral with the main body and extend from a common one of the edges by different first and second lengths, respectively. The first length is longer than said second length. The first and second spring beams being are aligned with the primary contact plane.

29 Claims, 9 Drawing Sheets

CONTACT FOR PIN GRID ARRAY CONNECTOR AND METHOD OF FORMING SAME

BACKGROUND OF THE INVENTION

Certain embodiments of the present invention relate to a pin grid array contact, and more particularly to an pin grid array contact that provides more efficient assembly into an electrical connector.

Connectors are known for interconnecting various electrical media components, such as printed circuit boards (PCB), discrete circuit components, flex circuits and the like. Many printed circuit boards are connected to pin grid substrates by way of ZIF (zero insertion force) connectors. Typically, ZIF connectors include single or double point contacts that connect conductive pins, which extend from the pin grid substrate, to traces on the printed circuit board. Typically, the pin grid substrate, the connector, and printed circuit board are compressed together in order to ensure a conductive path between the pins, contacts and the traces on the printed circuit board.

FIG. 1 is an isometric view of a conventional connector including pin grid substrate 10, a printed circuit board 16 and ZIF electrical connector 20. The pin grid substrate 10 includes a member 12 from which pins 14 outwardly extend. The circuit board 16 includes circuitry connected to plated through holes 18. The connector 20 includes a housing 22, contact elements 24, a cover 26 and a lever 28. The housing 22 carries a number of regularly spaced cavities (not shown), positioned below the pins 14. A groove 54 is open at one end 60 to accommodate the lever 28.

Two blocks 64 with holes 66 therethrough are located on each side of the housing 22. The holes receive roll pins 68. The blocks 64, holes and roll pins 68 cooperate with structures on the cover 26 to hold the cover on the housing 22. The cover 26, preferably molded with the same material as the housing 22, contains vertical openings 70 therethrough in the same number and on the same spacing as cavities in the housing 22.

Cam block 74 extends down below the lower surface 76 of the cover 26 and is channeled along its downwardly facing surface as indicated by reference numeral 78. One corner of the cover 26 adjacent end 80 is recessed as indicated by reference numeral 82 to provide room for the lever 28.

Blocks 84 extend downwardly from opposing sides 86 and 88 of the cover 26. Both blocks 84 are outwardly displaced relative to the vertical plane of the sides. Further, the block 84 on side 86 is displaced downwardly, relative to top surface 72, to provide a space for the arm of lever 28. Each block contains an aperture 90 in each end face to receive roll pin 68. One section of the member 92 extends outwardly from that side.

The lever 28, a one piece member, includes handle 96 and cam section 98. The cam section 98 is perpendicular to the handle 96. A short connecting piece 100 joins the handle 96 and cam section 98 and displaces one relative to the other. After loading the contact elements 24 into the cavities, the lever 28 is placed into the housing 22. The connecting piece 100 and the handle 96 extend out of the groove through open end 60.

The cover 26 is placed onto the top surface 32 so that blocks 84 slide in between blocks 64 and block 74 enters into the enlarged portion 58. The cover 26 is slidably attached to the housing 22 by sliding the roll pins 68 into the holes 66 in blocks 64 and the apertures 90 in the blocks 84. The cover 26 is actuated against the top surface 32 of the housing 22 by the pivoting handle 96 of the lever 28. Thus, the lever 28 provides the actuation necessary to mate the pins 14 with the contacts 24.

The contacts 24 may contact the pins 14 at a single point, or at two points. Typically, a contact 24 that contacts a pin 14 at a single point is less reliable than a contact 24 that contacts a pin 14 at two points. A contact 24 that contacts a pin 14 at two points, moreover, is a redundant contact system. A redundant contact system is more reliable than a single contact system in that if the pin is slightly out of position, while one contact may not abut the pin 14, another contact may abut the pin 14. In other words, two points of contact are better than one point of contact.

Typically, the two point contact straddles the pin 14, thereby offering another advantage over the single point contact. That is, the two point contact ensure proper positioning of the pin 14 because the pin 14 is positioned between two contact portions of the two point contact, as opposed to touching one point of contact, as with the single point contact.

Typically, two point contacts are stamped, or blanked, in conjunction with a carrier strip, from a unitary piece of conductive material. The two point contact is typically stamped such that the contact portions are oriented in a straight line. That is, one contact portion is located at one end of the line, while the other contact portion is located at the other end of the line.

FIG. 2 is an isometric view of a conventional two point contact 24. FIG. 3 is an illustration of a conventional preformed, blanked two point contact 24 attached to a carrier strip 140. As shown in FIG. 3, while in the preformed, blanked state, the contact portions 122 are aligned with one another such that the top surfaces 118 of the contact portions 122 are co-linear with each other. That is, line segment AB and line segment CD may be connected by dashed line BC, wherein line AD is a straight line. In order to form the contact, the contact portions 122 are bent as shown in FIG. 2.

Forming two point contacts through stamping or blanking, however, produces wasted material. As shown in FIG. 3, the stamped, preformed contact typically must be sufficiently wide to allow the proper size of the contacting portions 122, while at the same time ensuring that the contacting portions 122 will align with, or mirror, each other when the contact is formed. As a result, a greater portion of conductive material is wasted during the stamping process as compared to the stamping of a single point contact.

Further, unlike single point contacts, double point contacts typically cannot be stamped the same distance apart, that is, stamped on the same pitch, as that of the cavities in the connector housing. Typical connector housing cavities, or receptacles are positioned 1.27 mm, or 0.05", apart from one another. However, stamped double point contacts typically cannot be stamped that same distance from each other. The pitch, or spacing, between center lines of formed contacts on a carrier strip may be 0.10". Thus, when the double point contacts are inserted into the cavities, the contacts are individually inserted into the housing cavities. Alternatively the double point contacts may be skip inserted into the contacts because the contacts may be spaced twice the distance between the cavities of the connector housing. For example, a connector housing may include a matrix of 24 cavities by 24 cavities. If the contacts are skip inserted into a row (or column) of the matrix, 12 contacts may be inserted at one time. That is, the double point contacts may be stamped on double the pitch as that of the cavities.

Thus a need has existed for a more efficient way of method of stamping, or blanking double point micro pin grid array contacts. Further, a need has existed for a more efficient method of inserting double point pin grid array contacts into cavities or receptacles of a connector housing.

BRIEF SUMMARY OF THE INVENTION

In accordance with certain embodiments of the present invention, A pin grid array contact has been developed that comprises a planar main body defining, and arranged within, a primary contact plane. The main body has edges along opposed sides and along opposed ends. The contact also includes first and second spring beams integral with the main body and extending from a common one of the edges by different first and second lengths, respectively. The first length being longer than the second length. The first and second spring beams are aligned with the primary contact plane while the second spring beam may aligned in the primary contact plane. Optionally the second spring beam may be aligned with the primary contact plane, but may be bent toward the first spring beam, such that the second spring beam is no longer in the primary contact plane. The contact further comprises a paddle integral with and extending from one of the edges of the main body. The paddle is configured to adhere to a solder ball. The main body includes first and second radial positioners configured for positioning the main body into a cavity, or receptacle of a connector housing.

The first spring beam includes a first contacting portion located at a distal end of the first spring beam remote from the main body. The first and second contacting portions lie in different planes; and the first contacting portion is bent into alignment with the second contacting portion. Also, the second spring beam includes a second contacting portion located at a distal end of the second spring beam remote from the main body. The first and second spring beams are shifted laterally from one another with respect to a center line of the main body. The lateral shift is in a direction parallel to the primary contact plane.

While in the flat, stamped state, the second spring beam is offset from the first spring beam by a predetermined angle. The stamped double contacts are coplanar with the carrier strip. Then, the first and second spring beams are bent such that the first and second spring beams lie in different first and second planes, while the first contacting portion remains laterally aligned with the second contacting portion.

Certain embodiments of the present invention provide a method of forming a pin grid array contact. The method comprises stamping a contact having a main body formed with first and second spring beams from a planar single sheet of conductive material, in which the first and second spring beams have different first and second lengths that extend along first and second longitudinal axes, respectively. The first and second spring beams are aligned at an acute angle with one another and initially oriented in a primary contact plane defined by the main body. The method also comprises bending the second spring beam with respect to the main body until the second spring beam is located in a second beam plane that is separate from the primary contact plane. Additionally, the method comprises shifting the first and second spring beams laterally from one another with respect to a center line of the main body. The shifting step occurring in a direction parallel to the primary contact plane. Also, the method comprises aligning a first contacting portion of the first spring beam into alignment with a second contacting portion of the second spring beam.

Certain embodiments of the present invention also provide the following steps: providing a carrier strip integral with a plurality of the contacts in the primary contact plan; positioning adjacent contacts so that a distance between center lines of the adjacent contacts corresponds to a distance between two cavities located on a connector housing; and stamping a paddle on the main body and bending the paddle to be perpendicular to the main body of each contact.

Figure 1:
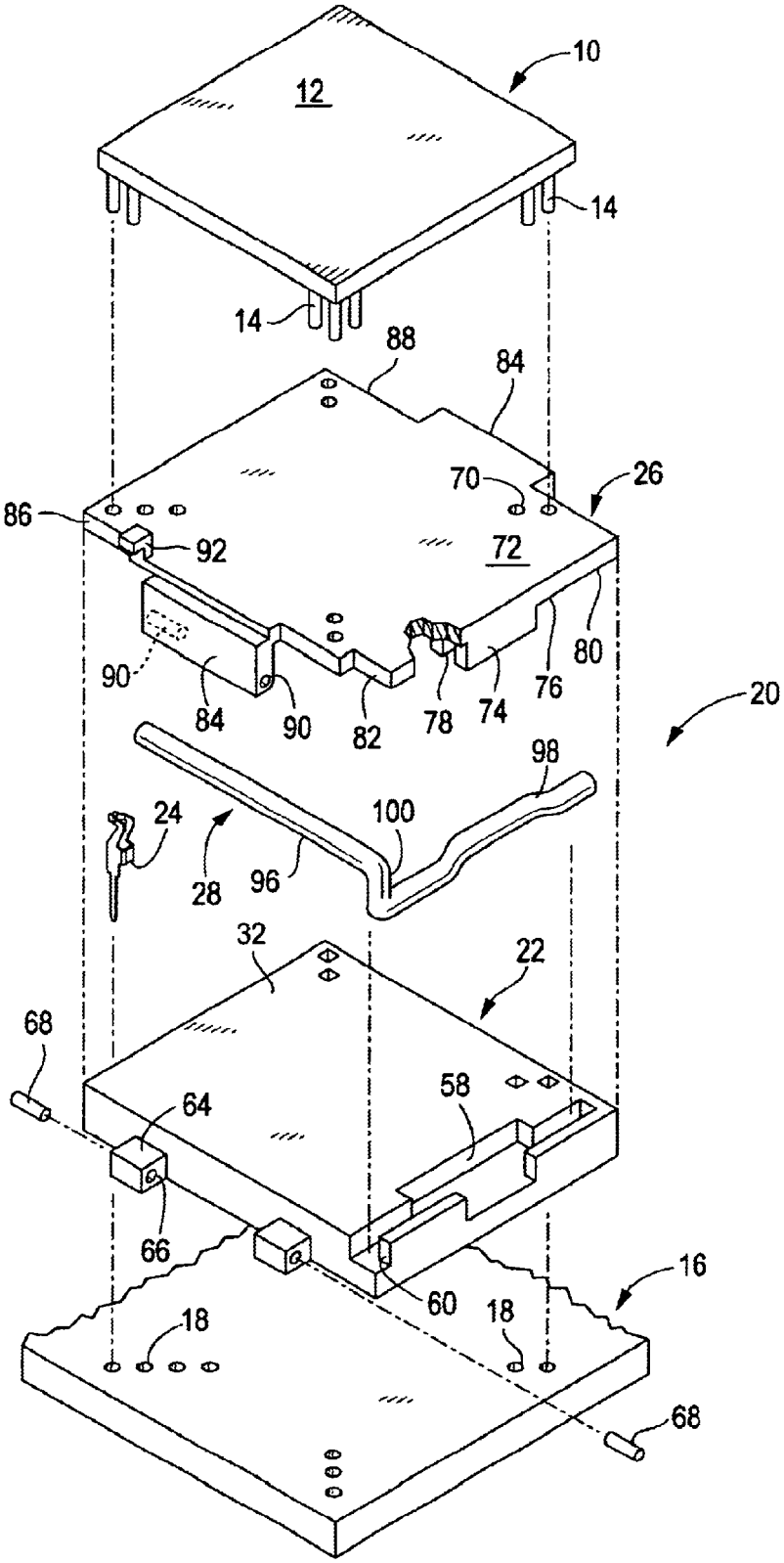
FIG. 1 PRIOR ART
FIG. 1 is an isometric view of a conventional connector with a pin grid substrate, a printed circuit board and a ZIF (zero insertion force) electrical connector.
Figure 2:
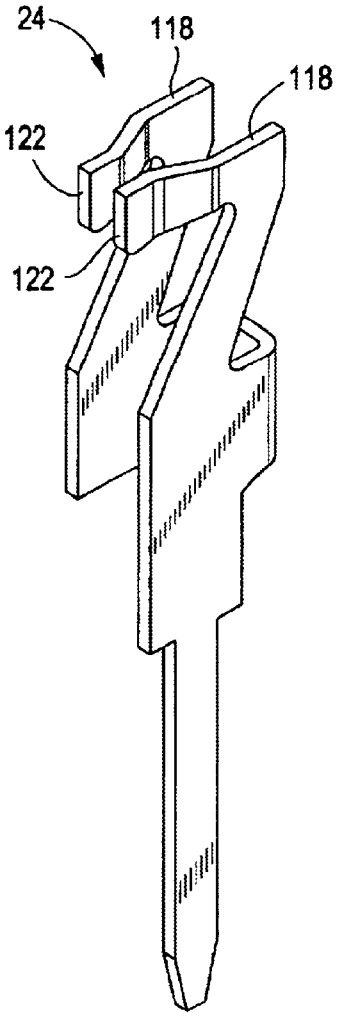
FIG. 2 PRIOR ART
FIG. 2 is an isometric view of a conventional two point contact.
Figure 3:
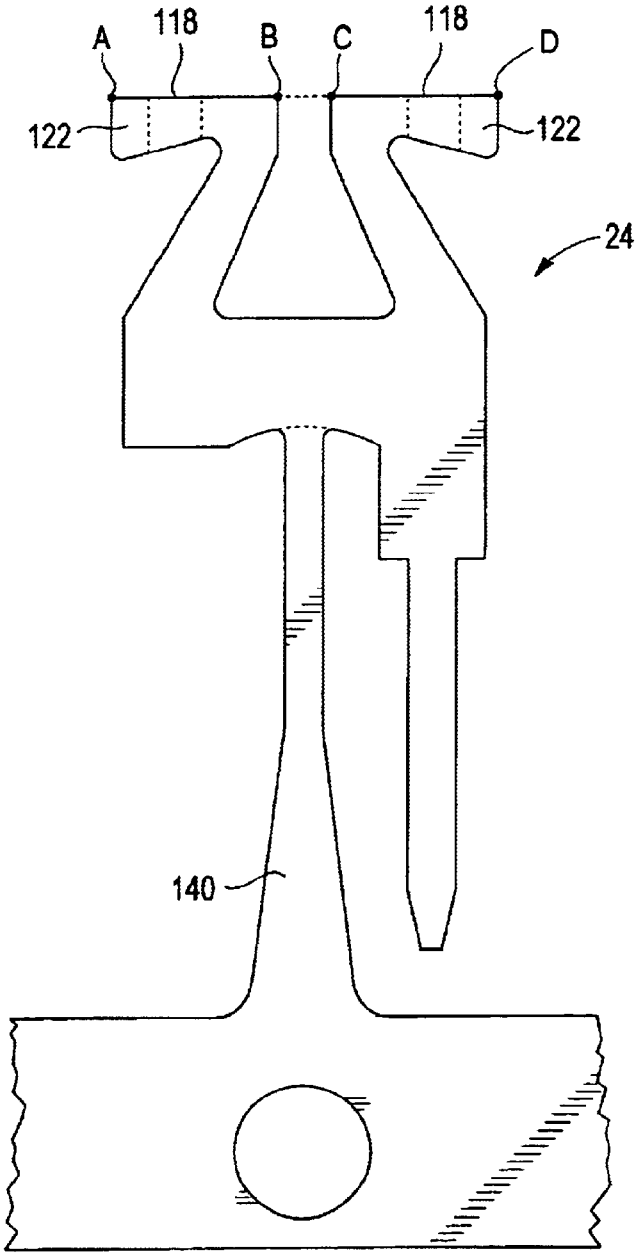
FIG. 3 PRIOR ART
FIG. 3 illustrates a conventional preformed, blanked two point contact attached to a carrier strip.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

Figure 4:
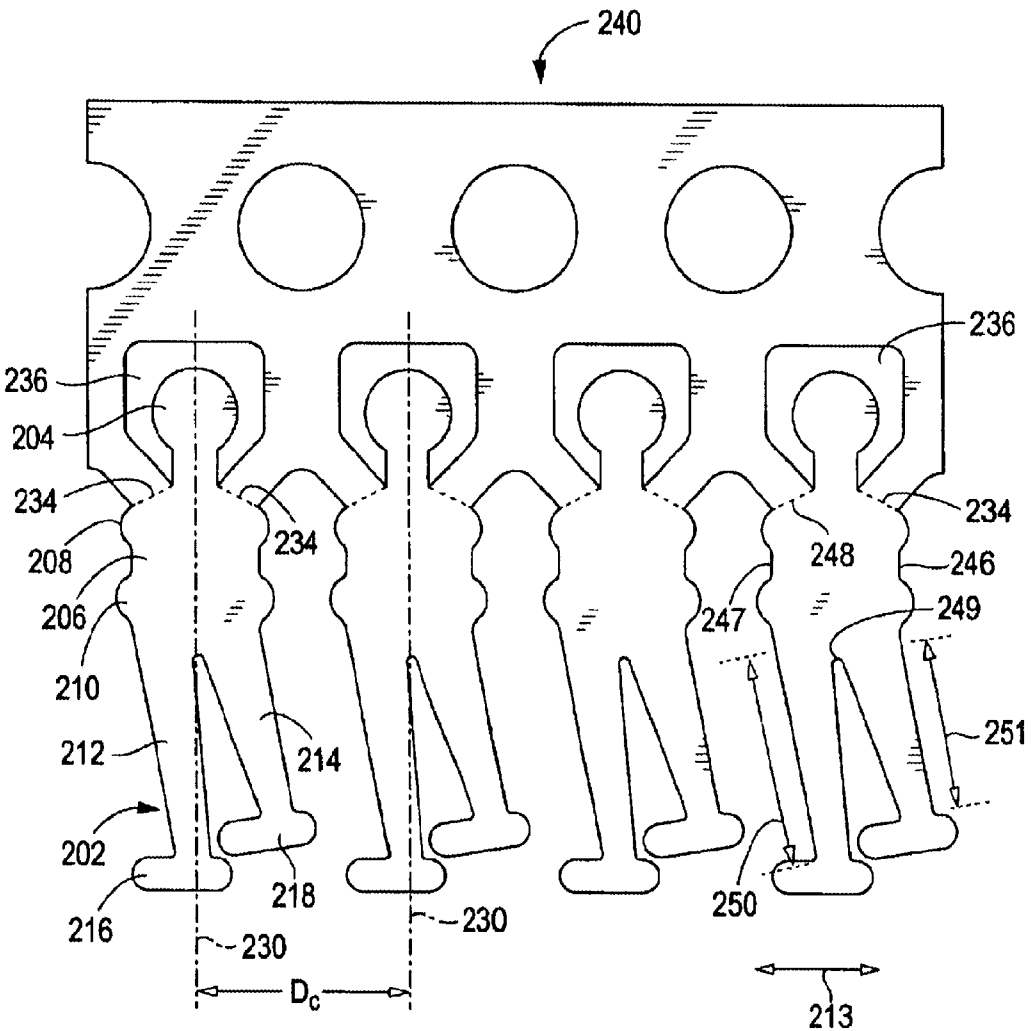
FIG. 4 is a front view of a carrier strip carrying a plurality of flat blanked contacts formed in accordance with an embodiment of the present invention.
Figure 5:
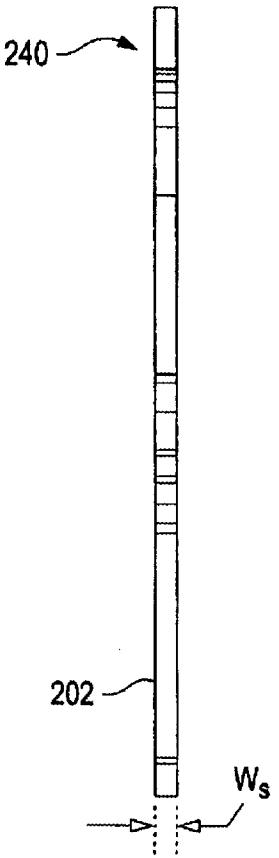
FIG. 5 is an end view of a carrier strip carrying a plurality of flat blanked contacts formed in accordance with an embodiment of the present invention.

FIG. 4 is a front view of a carrier strip 240 carrying a plurality of flat blanked contacts 202 formed in accordance with an embodiment of the present invention. FIG. 5 is an end view of a carrier strip 240 carrying a plurality of flat blanked contacts 202 formed in accordance with an embodiment of the present invention. The carrier strip 240 and the flat blanked contacts 202 are formed from a unitary, planar piece of conductive material, such as a copper alloy having a suitable plating, such as tin, lead or nickel. The carrier strip 240 includes cavities 236 and connection joints 234 that join the carrier strip 240 to the flat blanked contacts 202. The connection joints 234 may be perforated to facilitate the release of the individual contacts 202 from the carrier strip 240.

Each flat blanked contact 202 is coplanar with the carrier strip 240. Each contact 202 includes a paddle 204, first radial positioners 208, second radial positioners 210, a main body 206, a first spring beam 212, a second spring beam 214, a first contacting portion 216 connected to the first spring beam 212, and a second contacting portion 218 connected to the second spring beam 214. The main body 206 has opposed side edges 246, 247 and opposed end edges 248, 249. The first and second spring beams 212 and 214 are stamped integral with, and extend outward from end edge 249. The first spring beam 212 extends a length 250 from the end edge 249, while the second spring beam 214 extends a length 251 from the same end edge 249. The first and second spring beams 212 and 214 are shifted laterally in the direction of arrow 213 from one another on opposite sides of the center line 230. The lateral shift is parallel to the primary contact plane. The center line of each contact 202 is denoted by reference line 230 that is contained within a primary contact plane. The width of the carrier strip 240 and the contacts 202 in the preformed blanked state, as shown in FIG. 5, is denoted by $W_S$. The distance ($D_C$) represents the distance between the center lines 230 of adjacent contacts 202. The contacts 202 may be flat blanked such that the distance ($D_C$) between their center lines 230 is less than or equal to 1.27 mm, or 0.05' apart from one another.

The carrier strip 240 and the contacts 202 are stamped, or blanked, from a single planar sheet, coil, or slab of conductive material. As shown in FIG. 4, while in the blanked, preformed state, the first spring beam 212 is longer than the second spring beam 214. In the preformed state, the first spring beam 212 and the second spring beam 214 are aligned in the primary contact plane, which is defined by the main body 206. Once stamped, the second spring beam 214 is angled away, or offset, from the first spring beam 212 by approximately 20°. Further, the first contacting portion 216 and the second contacting portion 218 are not aligned with one another while in the blanked, preformed state. Also, the lengths of the first contacting portion 216 and the second contacting portion 218 do not lie on a common straight line. Because the first and second spring beams 212 and 214 are oriented as shown in FIG. 4 while in the blanked, preformed state, adjacent contacts 202 may be blanked, or stamped, closer to one another than previously blanked contacts. Thus, the contacts 202 may be blanked, or stamped, such that the distance ($D_C$) between respective center lines 230 is the same distance between connector housing cavities, or receptacles. For example, the distance ($D_C$) between the center lines 230 of adjacent contacts 202 may be 1.27 mm, or 0.05", which is also the same distance between the centers of connector housing receptacles, or cavities, into which the contacts are eventually positioned.

Further, because the contacts 202 are stamped or blanked closer together, more of the original sheet of conductive material is utilized, thereby producing less wasted conductive material than in previous blanking processes. The forming process, which includes a series of bends and cants of the contacts 202 by way of a forming die, as described below with respect to FIGS. 6–10, enables the contacts 202 to be blanked within a close spacing, such as 1.27 mm, or 0.05", from one another.

Figure 9:
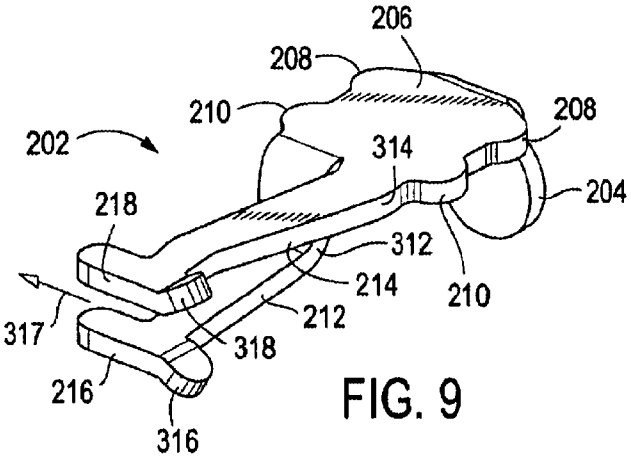
FIGS. 9 and 10 are isometric views of a contact formed in accordance with an embodiment of the present invention.
Figure 10:
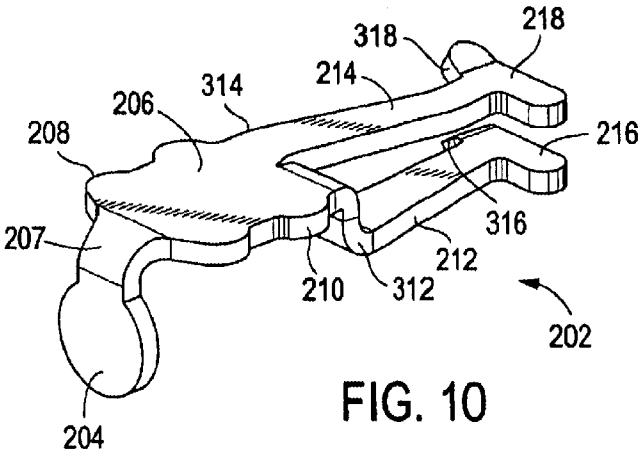
Figure 8:
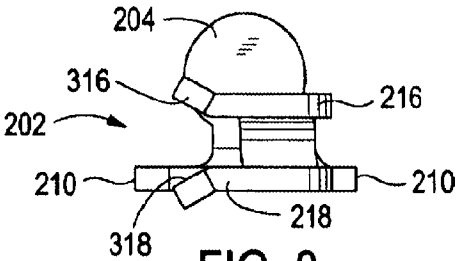
FIG. 8 is a top view of a contact formed in accordance with an embodiment of the present invention.
Figure 7:
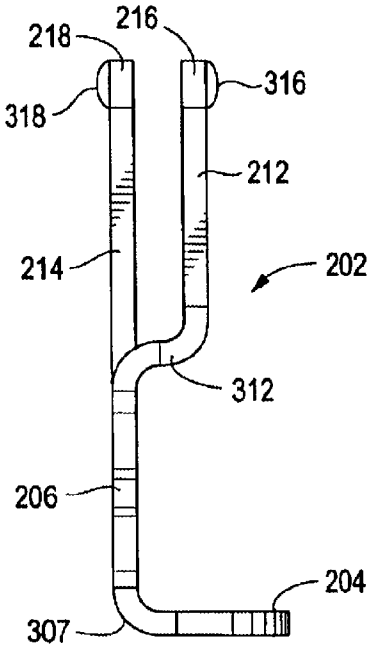
FIG. 7 is a side view of a contact formed in accordance with an embodiment of the present invention.
Figure 6:
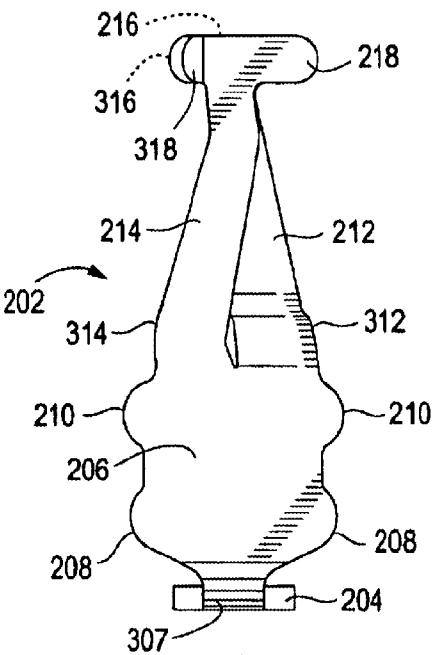
FIG. 6 is a front view of a contact formed in accordance with an embodiment of the present invention.
Figure 11:
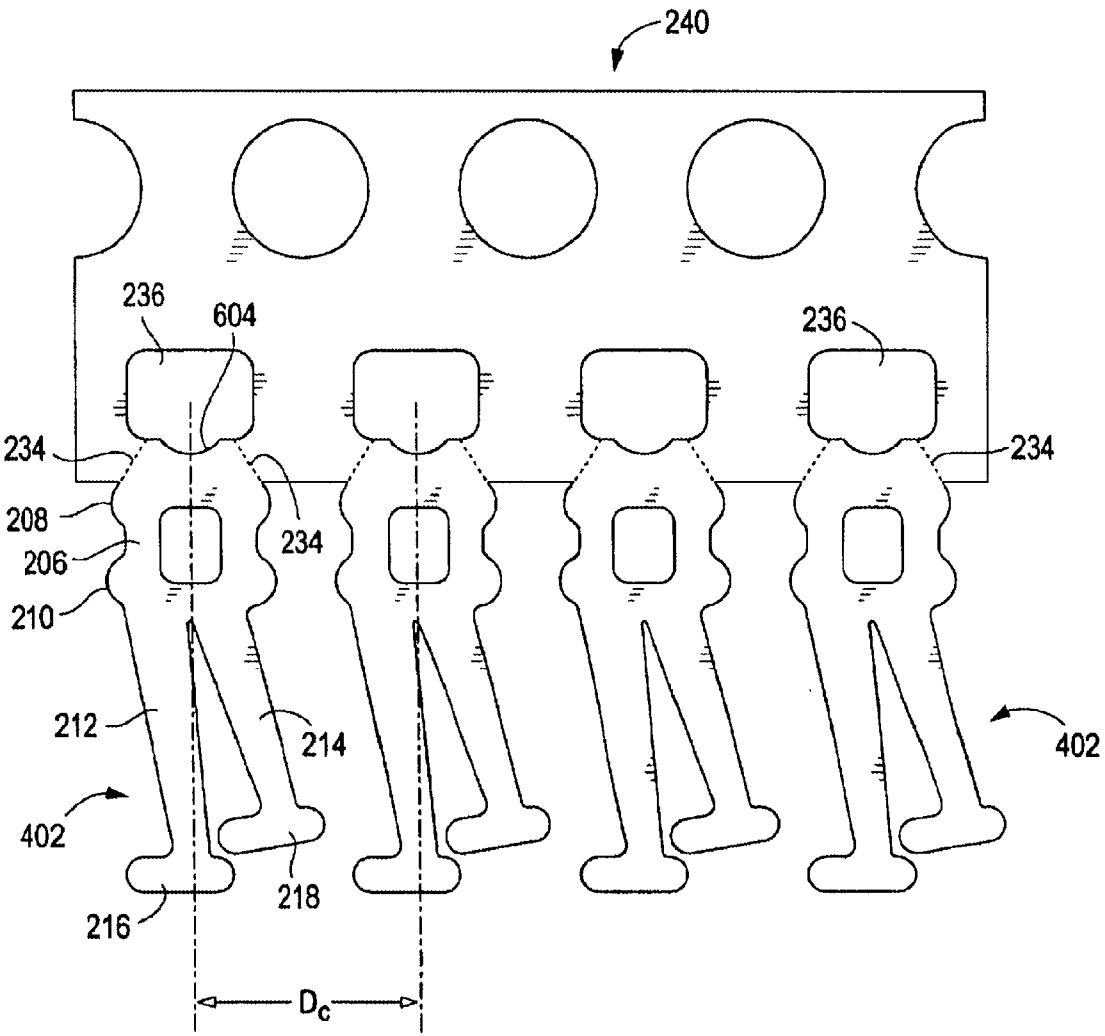
FIG. 11 is a front view of a carrier strip carrying a plurality of flat blanked contacts formed in accordance with an alternative embodiment of the present invention.
Figure 12:
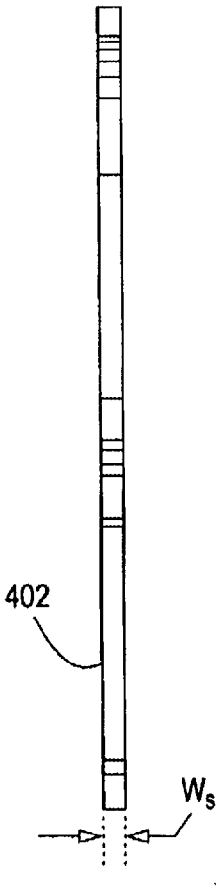
FIG. 12 is an end view of a carrier strip carrying a plurality of flat blanked contacts formed in accordance with an alternative embodiment of the present invention.
Figure 16:
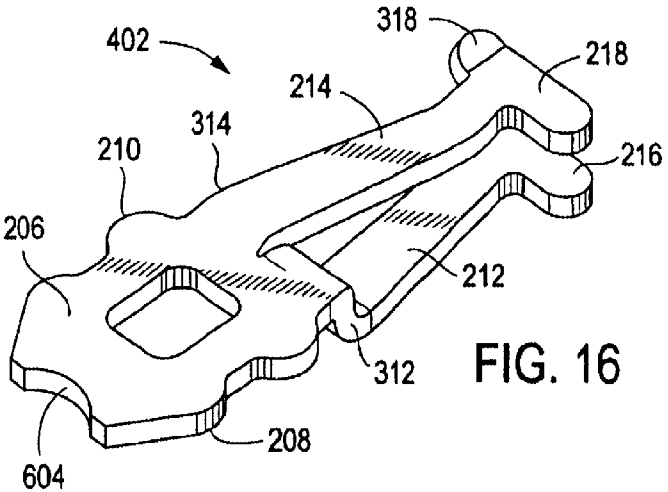
FIGS. 16 and 17 are isometric views of a contact formed in accordance with an alternative embodiment of the present invention.
Figure 17:
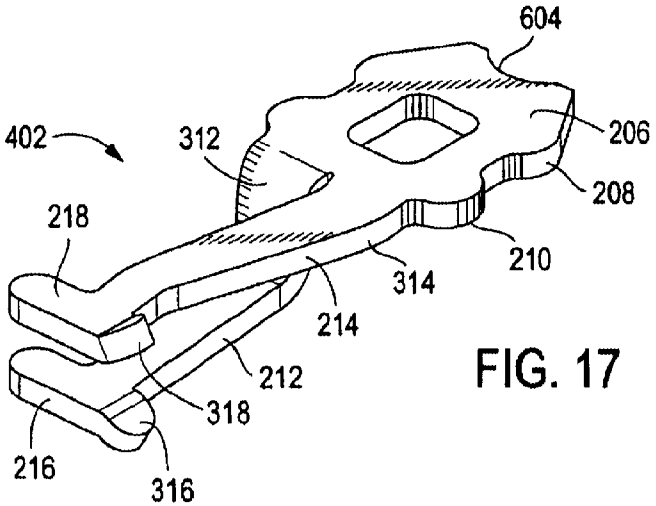
Figure 15:
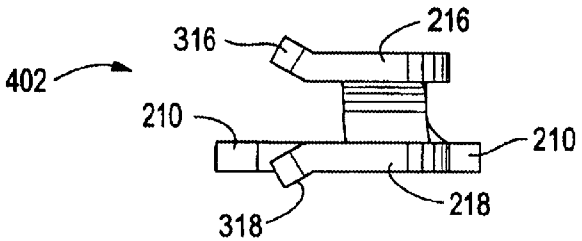
FIG. 15 is a top view of a contact formed in accordance with an alternative embodiment of the present invention.
Figure 14:
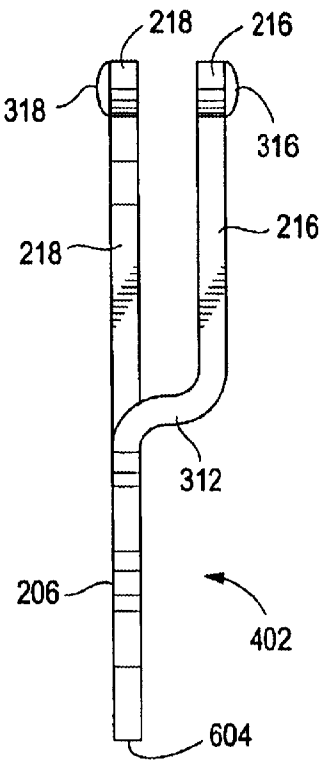
FIG. 14 is a side view of a contact formed in accordance with an alternative embodiment of the present invention.
Figure 13:
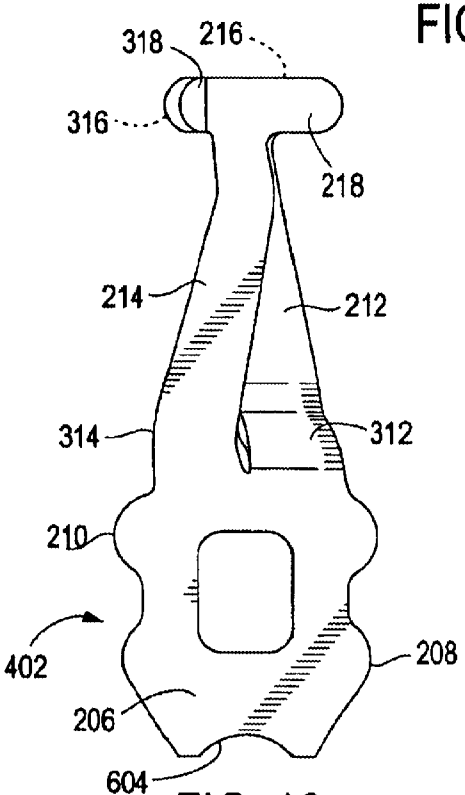
FIG. 13 is a front view of a contact formed in accordance with an alternative embodiment of the present invention.

FIG. 6 is a front view of a contact 202 formed in accordance with an embodiment of the present invention. FIG. 7 is a side view of the contact 202 formed in accordance with an embodiment of the present invention. FIG. 8 is a top view of the contact 202 formed in accordance with an embodiment of the present invention. FIGS. 9 and 10 are isometric views of the contact 202 formed in accordance with an embodiment of the present invention. The formed contact 202 is similar to the flat blanked contact 202 except that the formed contact 202 has been bent, canted and otherwise formed through a die. The contact 202 may be formed while still on the carrier strip 240.

During the forming process, the first spring beam 212 is bent out from the plane of the main body 206 at bend 312. The first spring beam 212 is bent to be parallel with, but no longer coplanar with, the plane of the main body 206 (and therefore the carrier strip 240). Further, the second spring beam 214 is canted, at bend 314, toward the first spring beam 212 such that the first contacting portion 216 and the second contacting portion 218 are aligned with each other, that is, the first contacting portion 216 is parallel, but not coplanar, with the second contacting portion 218. While the second spring beam 214 is canted toward the first spring beam 212, the second spring beam 214 remains in the same plane as the main body 206 (and the carrier strip 240, when the contact 202 is formed while it is still attached to the carrier strip 240). That is, the second spring beam 214 remains aligned in the primary contact plane, while the first spring beam 212 is aligned with, but not in, the primary contact plane. The bending and canting of the spring beams 212 and 214 allows the spring beams 212 and 214 to be stamped closer to one another, than in previous stamping, or blanking processes.

Additionally, the first contacting portion 216 and the second contacting portion 218 are formed such that first and second contacting tips 316 and 318 are bent outward from the plane of the main body 206, that is, the primary contact plane. Additionally, during the forming process, the paddle 204 is bent at bend 307 such that the plane of the paddle 204 is perpendicular to the plane of the main body 206.

If the contacts 202 are formed while still connected to the carrier strip 240, adjacent contacts 202 remain the distance $D_C$ from one another. Thus, an entire row, or column, of contacts 202 may be inserted into cavities of a connector housing because the distance ($D_C$) between the center lines 230 of adjacent contacts 202 remains the same as the distance between the centers of connector housing receptacles, or cavities, into which the contacts 202 are eventually positioned. For example a connector housing may be oriented in a pin grid array that is 25 cavities by 25 cavities. Because the contacts 202 may be formed on the carrier so that they are the same distance apart as the cavities, the contacts 202 may be inserted simultaneously from the carrier strip 240 into a row or column of cavities.

Figure 18:
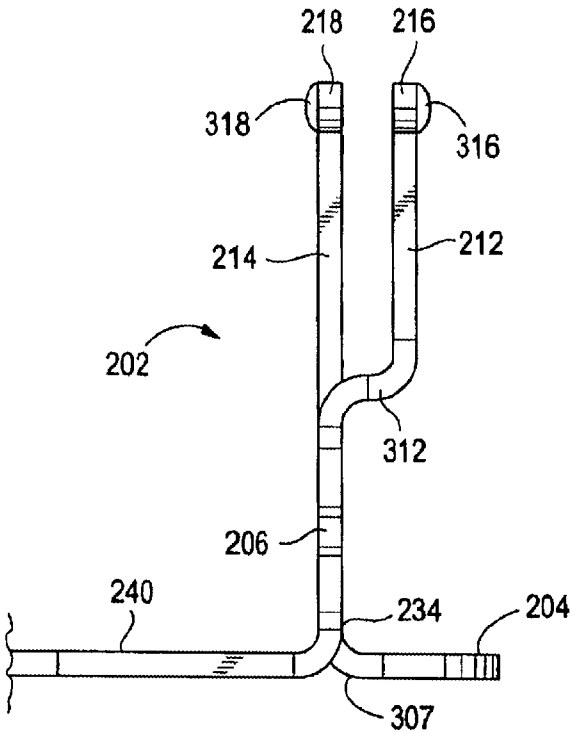
FIG. 18 is a side view of a contact and a carrier strip prior to insertion of the contact into the connector housing according to an embodiment of the present invention.

FIG. 18 is a side view of a contact 202 and a carrier strip 240 prior to insertion of the contact 202 into the connector housing according to an embodiment of the present invention. In order to fasten the contacts 202 within the cavities of the connector housing (such as housing 22, shown in FIG. 1) upon mass insertion of the formed contacts 202 into the cavities, solder balls may be positioned on the paddles 204. For example, a solder ball having a diameter of approximately 0.03" may be attached to the bottom of the paddle 204. After forming, the paddles 204 may be oriented in a plane that is perpendicular to the carrier strip 240. That is, the contacts 202 may be bent at the connection joints 234 such that the main bodies 206 of the contacts 202 are perpendicular to the carrier strip 240. The solder balls may be attached to the paddles 204 before insertion, or the solder balls may be positioned within the cavities prior to insertion of the contacts 202 into the cavities.

Figure 19:
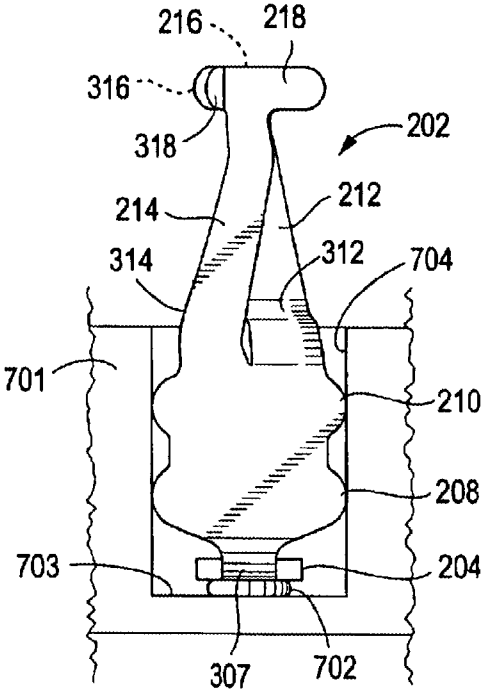
FIG. 19 is a side view of a contact positioned within a cavity of a connector housing according to an embodiment of the present invention.

FIG. 19 is a side view of a contact 202 positioned within a cavity 704 of a connector housing 701 according to an embodiment of the present invention. A solder ball 702 is positioned between the paddle 204 and the cavity base 703. Prior to insertion into the connector housing 701, each paddle 204 is oriented in a plane that is parallel to the surface of the connector housing 701. Once the contacts 202 are inserted into cavities 704 to a depth at which the carrier strip 240 abuts against or is closest to the connector housing 701, the carrier strip 240 is severed from the contacts 202 at the connection joints 234. Optionally, the carrier strips 240 may be severed shortly after the first and second contacting portions 216 and 218 are started into the cavities 704 (if inserted upward) or shortly after the paddle 204 is started into the cavities 704 (if inserted downward). Alternatively, the carrier strip 240 may be severed from the contacts 202 before insertion, in which case a separate insertion strip may engage the contacts 202 by the contacting portions 216 and 218 and position the contacts 202 into the cavities 704, or receptacles of the connector housing 701. In each case, individual positioning of the contacts 202 is not required. For example, if the contacts 202 are bent in the carrier strip 240, all of the contacts 202 may be mass inserted into the cavities 704 of the connector housing 701. Alternatively, if the contacts 202 are first severed from the carrier strip 240, a separate insertion strip may attach to the first and second contacting portions 216 and 218, such as by an electromagnetic force, while the contacts 202 are severed from the carrier strip. In both cases, the contacts 202 remain the same distance ($D_C$) from one another. Therefore, the insertion process is more efficient than previous insertion processes.

As the contacts 202 are inserted into the cavities 704 of the connector housing 701, the first radial positioners 208 engage the interior walls of the cavities 704 and facilitate proper alignment of the contacts 202 during the assembly stroke, that is, the insertion process. As the contacts 202 are further inserted into the cavities 704, the second radial positioners 210 engage the interior walls of the cavities such that there are four points of contact between each contact 202 and the interior walls of the cavity 704 into which the contact 202 is inserted. Thus, each cavity 704 within the connector housing 701 receives a contact 202 and retains the contact 202 through the first and second radial positioners 208 and 210. Further, each paddle 204 rests on a base 703 of a cavity 704 such that an attached solder ball 702 is positioned between the base 703 of the cavity 704 and the paddle 204. As mentioned above, solder balls 702 may be attached directly to the paddles 204. Alternatively, solder balls 702 may be inserted into the cavities 704 before the contacts 202 are inserted into the cavities 704. Also alternatively, instead of utilizing a paddle 204, the contact 202 may include a solder pin, which receives a solder ball 702. Once the contacts 202 are positioned within the cavities 704, the base of the connector housing 701 is heated in order to solder the paddles 204 to the bases of the cavities.

After the contacts 202 are inserted, the connector housing 701, the printed circuit board and the pin grid substrate may be compressed together. Upon compression, or actuation of the cover against the connector housing 701 (similar to the connector housing 22 shown in FIG. 1), conductive pins, such as pins 14 shown in FIG. 1, are received by the first and second contacting portions 216 and 218 of the contacts 202. During the mating of the pins 14 to the contacts 202, the mating surface of each pin 14 is laterally slid between the first and second contacting portions 216 and 218 (such as in the direction of arrow 317 of FIG. 9). The tips 316 and 318 (as shown in FIG. 9) of the first and second contacting portions 216 and 218 are bent outward in order to facilitate proper insertion of a pin. That is, the orientation of the tips 316 and 318 decreases the possibility of a pin 14 stubbing, or otherwise not being fully engaged with, the first and second contacting portions 216 and 218. The actuation provided by an actuation mechanism, such as lever 28 in FIG. 1, slides the pins 14 between the first and second contacting portions 216 and 218. When the pins 14 are fully engaged through the actuation provided by the lever, each pin 14 is contacted on opposite sides by a contact 202. That is, the first contacting portion 216 and the second contacting portion 218 of a contact 202 simultaneously contact one pin 14.

Figure 20:
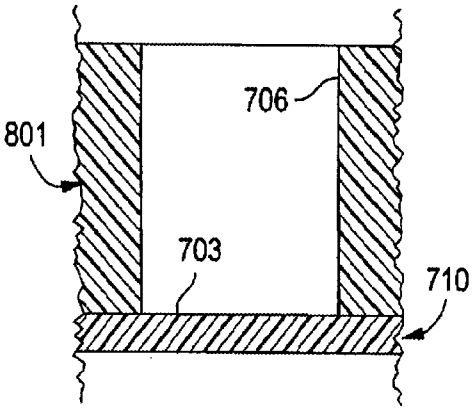
FIG. 20 is a cross-sectional view of a cavity formed in accordance with an embodiment of the present invention.

FIG. 20 is a cross-sectional view of a connector housing 801 having a cavity 706 and housing base 710 formed in accordance with an embodiment of the present invention. In this example, the contact 202 may be inserted from the cavity base 703 when the housing base 710 is removed. After the contact 202 is positioned within the cavity 706, the housing base 710 is attached to the cavity 706.

Figure 21:
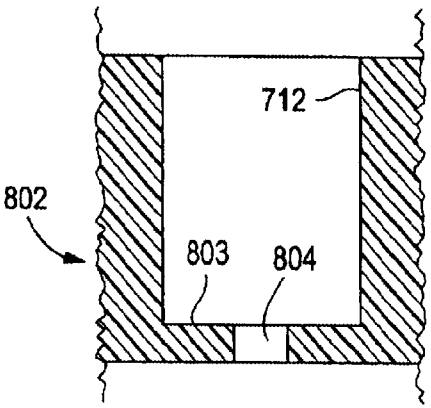
FIG. 21 is a cross-sectional view of a cavity formed in accordance with an embodiment of the present invention.

FIG. 21 is a cross-sectional view of a connector housing 802 having a cavity 712 formed in accordance with an embodiment of the present invention. The connector housing 802 includes a base 803 and a channel 804. The channel 804 may be used as a path to deliver a solder ball and/or a conductive path to electrical elements (not shown) and/or traces (not shown) within the connector housing.

FIGS. 11–17 illustrate contacts 402 formed in accordance with an alternative embodiment of the present invention. Common reference numerals have been assigned to common structure of the contacts 402 of FIGS. 11–17 and the contact 202 of FIGS. 4–10. The contact 402, however, includes a solder depression 604, instead of the paddle 204 of the contact 202 as shown in FIGS. 4–10. Thus, when the contact 402 is inserted into a cavity of the connector housing, the solder depression 604 contacts a solder ball positioned on the base of the cavity.

Figure 22:
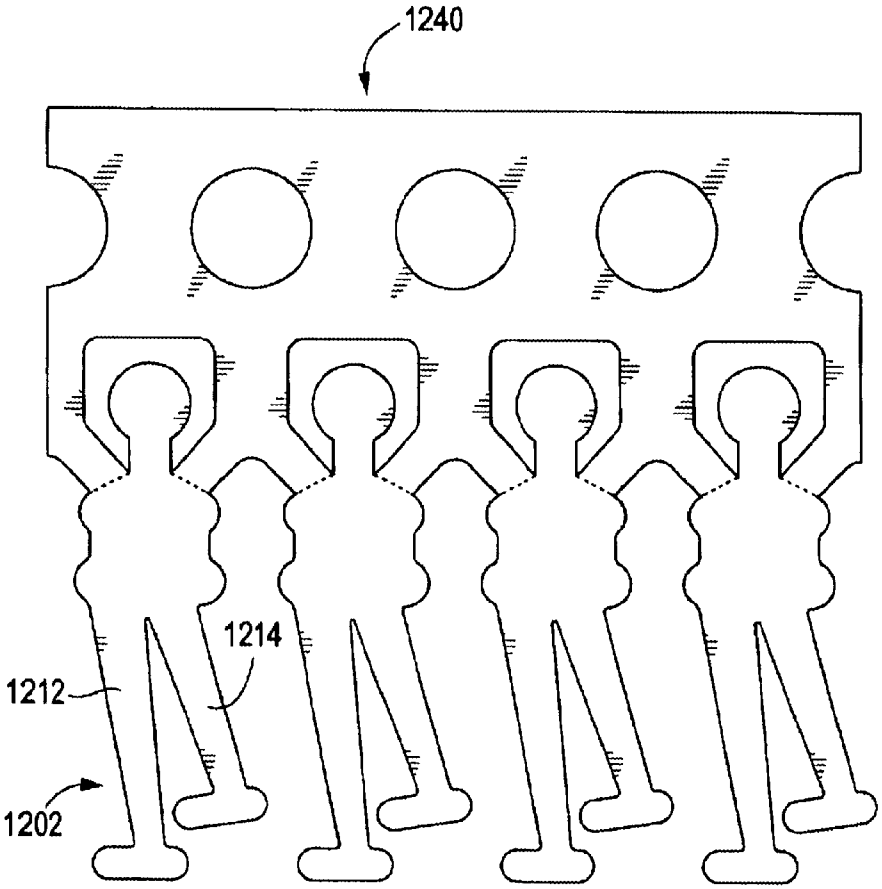
FIG. 22 is a front view of a carrier strip carrying a plurality of flat blanked contacts formed in accordance with an embodiment of the present invention.
Figure 23:
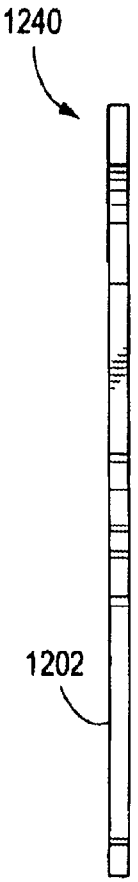
FIG. 23 is an end view of a carrier strip carrying a plurality of flat blanked contacts, formed in accordance with an embodiment of the present invention.

FIG. 22 is a front view of a carrier strip 1240 carrying a plurality of flat blanked contacts 1202 formed in accordance with an embodiment of the present invention. FIG. 23 is an end view of a carrier strip 1240 carrying a plurality of flat blanked contacts 1202 formed in accordance with an embodiment of the present invention. A comparison between FIGS. 22 and 23 with FIGS. 4 and 5 show that the first spring beam 1212 may be slightly longer and narrower than the spring beam 212. Also, the second spring beam 1214 may be slightly narrower than the spring beam 214. Also, the angle of the offset between spring beam 1214 and spring beam 1212 may be slightly more than that between spring beam 214 and spring beam 212. The same beam configuration may be used with contacts 402.

Figure 24:
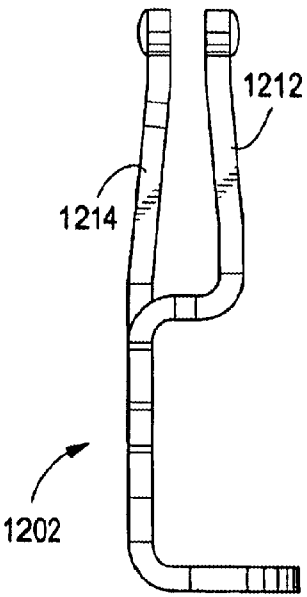
FIG. 24 is a side view of a contact formed in accordance with an embodiment of the present invention.
Figure 25:
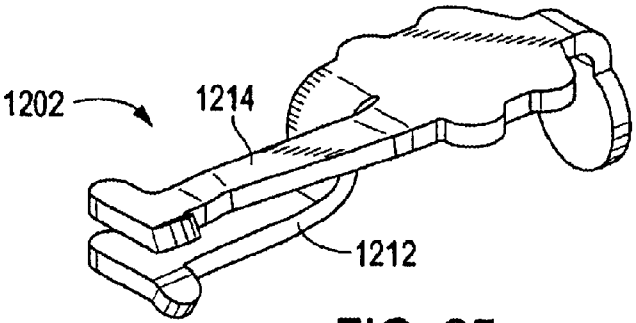
FIGS. 25 and 26 are isometric views of a contact formed in accordance with an embodiment of the present invention.
Figure 26:
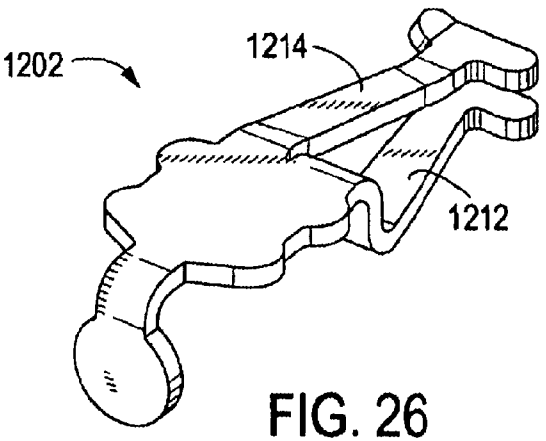
Figure 28:
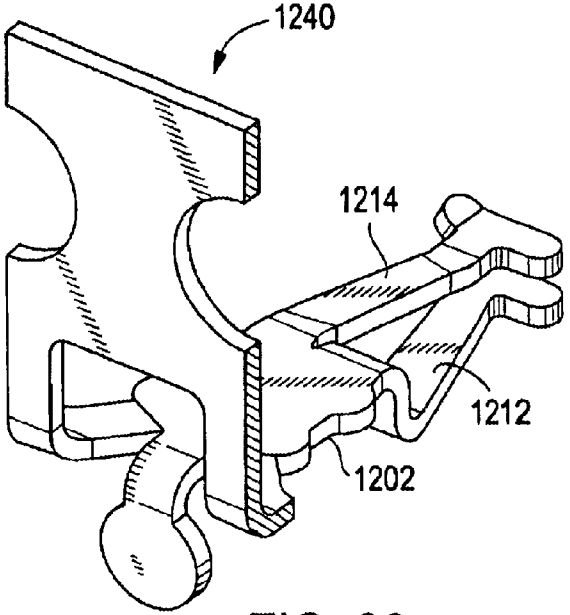
FIG. 28 is an isometric view of a contact and carrier strip prior to insertion of the contact into the connector housing according to an embodiment of the present invention.
Figure 27:
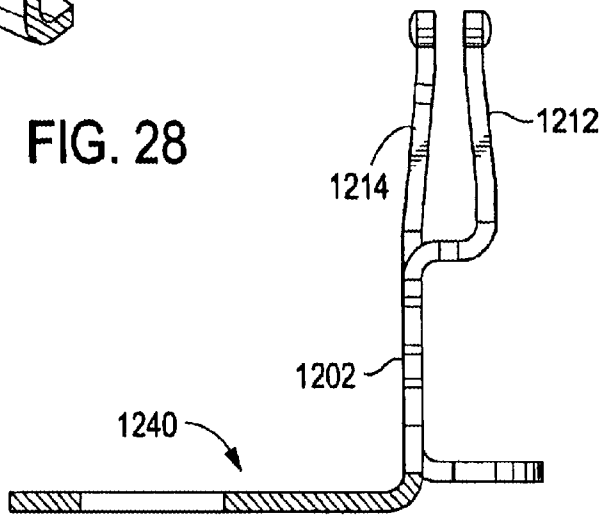
FIG. 27 is a side view of a contact and a carrier strip prior to insertion of the contact into the connector housing according to an embodiment of the present invention.

FIG. 24 is a front view of a contact 1202 formed in accordance with an embodiment of the present invention. FIGS. 25 and 26 are isometric views of the contact 1202 formed in accordance with an embodiment of the present invention. As shown in FIGS. 24–26, the second spring beam 1214 may be bent toward the first spring beam 1212. FIGS. 27 and 28 show the contact 1202 and a carrier strip 1240 prior to insertion of the contact 1202 into the connector housing according to an embodiment of the present invention.

Various embodiments of the present invention provide a more efficient method of blanking, or stamping, micro pin grid array contacts, and provide a more efficient method of inserting the contacts into cavities of a connector housing.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A pin grid array contact, comprising:

a planar main body defining, and arranged within, a primary contact plane, said main body having edges along opposed sides and along opposed ends; and first and second spring beams integral with said main body and extending from a common one of said edges by different first and second lengths, respectively, said first length being longer than said second length, said first and second spring beams being aligned parallel with said primary contact plane, and said second spring beam being aligned in said primary contact plane.

2. The contact of claim 1 further comprising a paddle integral with and extending from one of said edges of said main body, said paddle being configured to adhere to a solder ball.

3. The contact of claim 1 wherein said first spring beam includes a first contacting portion located at a distal end of said first spring beam remote from said main body, and wherein said second spring beam includes a second contacting portion located at a distal end of said second spring beam remote from said main body.

4. The contact of claim 1 wherein said first and second spring beams are shifted laterally, from one another with respect to a center line of said main body, said lateral shift being in a direction parallel to said primary contact plane.

5. The contact of claim 1 wherein said main body includes first and second radial positioners configured for positioning said main body into a cavity of a connector housing.

6. The contact of claim 3 wherein said first and second contacting portions lie in different planes, and wherein said first contacting portion is bent into alignment with said second contacting portion.

7. The system of claim 1 wherein said second spring beam is canted toward said first spring beam.

8. An assembly including a plurality of double point contacts formed from a single sheet of conductive material, said assembly comprising:

a carrier strip; defining a carrier plane and a plurality of stamped double point contacts connected to said carrier strip, each of said contacts including a main body joined with a first spring beam and a second spring beam, said first spring beam including a first contacting portion located at a distal end of said first spring beam, said second spring beam including a second contacting portion located at a distal end of said second spring beam, said first spring beam being longer than said second spring beam, said second spring beam being offset such that projections of said first and second spring beams onto said carrier plane form an angle with respect to one another, said stamped double contacts being coplanar with said carrier strip; and said first spring beam being bent such that said first and second spring beams lie in different first and second planes, while said first contacting portion remains laterally aligned with said second contacting portion.

9. The system of claim 8 wherein each of said contacts includes a paddle joined with said main body, said paddle being bent so that said paddle lies in a plane that is perpendicular to a plane containing said main body.

10. The system of claim 8 wherein said carrier strip holds said plurality of stamped double point contacts such that a center line of each contact is spaced a predetermined distance from a center line of an adjacent contact, said predetermined distance equaling a spacing between adjacent cavities in a connector housing.

11. The system of claim 8 wherein said second spring beam is canted toward said first spring beam.

12. A method of forming a pin grid array contact, comprising:

stamping a contact having a main body formed with first and second spring beams from a planar single sheet of conductive material, the first and second spring beams having different first and second lengths that extend along first and second longitudinal axes, respectively, that are aligned at an acute angle with one another and initially oriented in a primary contact plane defined by the main body; and bending the first spring beam with respect to the main body until the first spring beam is located in a second beam plane that is separate from the primary contact plane.

13. The method of claim 12 further including providing a carrier strip integral with a plurality of the contacts in the primary contact plane.

14. The method of claim 12 further including positioning adjacent contacts so that a distance between center lines of the adjacent contacts corresponds to a distance between two cavities located on a connector housing.

15. The method of claim 12 further including aligning a first contacting portion of the first spring beam immediately adjacent a second contacting portion of the second spring beam.

16. The method of claim 12 further including stamping a paddle on the main body and bending the paddle to be perpendicular to the main body of each contact.

17. The method of claim 12 further including shifting the first and second spring beams laterally from one another with respect to a center line of the main body, said shifting step occurring in a direction parallel to the primary contact plane.

18. The method of claim 12 further including aligning a first contacting portion of the first spring beam into alignment with a second contacting portion of the second spring beam.

19. A method of forming a pin grid array contact, comprising:

stamping a contact having a main body formed with first and second spring beams from a planar sheet of conductive material, the first and second spring beams having different first and second lengths that extend along first and second longitudinal axes, respectively, that are aligned at an acute angle with one another and initially oriented in a primary contact plane defined by the main body;

bending the first spring beam with respect to the main body until the second spring beam is located in a second beam plane that is separate from the primary contact plane;

shifting the first and second spring beams laterally from one another with respect to a center line of the main body, said shifting step occurring in a direction parallel to the primary contact plane; and aligning a first contacting portion of the first spring beam into alignment with a second contacting portion of the second spring beam.

20. The method of claim 19 further including providing a carrier strip integral with a plurality of the contacts in the primary contact plane.

21. The method of claim 19 further including positioning adjacent contacts so that a distance between center lines of the adjacent contacts corresponds to a distance between two cavities located on a connector housing.

22. The method of claim 19 wherein said aligning step includes aligning a first contacting portion of the first spring beam immediately adjacent a second contacting portion of the second spring beam.

23. The method of claim 19 further including stamping a paddle on the main body and bending the paddle to be perpendicular to the main body of each contact.

24. A pin grid array contact, comprising:

a planar main body defining, and arranged within, a primary contact plane, said main body having edges along opposed sides and along opposed ends;

first and second spring beams integral with said main body and extending from a common one of said edges by different first and second lengths, respectively, said first length being longer than said second length, said first and second spring beams being aligned with said primary contact plane.

25. The contact of claim 24 further comprising a paddle integral with and extending from one of said edges of said main body, said paddle being configured to adhere to a solder ball.

26. The contact of claim 24 wherein said first spring beam includes a first contacting portion located at a distal end of said first spring beam remote from said main body, and wherein said second spring beam includes a second contacting portion located at a distal end of said second spring beam remote from said main body.

27. The contact of claim 24 wherein said first and second spring beams are shifted laterally from one another with respect to a center line of said main body, said lateral shift being in a direction parallel to said primary contact plane.

28. The contact of claim 24 wherein said main body includes first and second radial positioners configured for positioning said main body into a cavity of a connector housing.

29. The contact of claim 26 wherein said first and second contacting portions lie in different planes, and wherein said first contacting portion and said second contacting portion are bent into alignment with one another.

* * * * *